US009180479B1

(12) United States Patent
Ries

(10) Patent No.: US 9,180,479 B1
(45) Date of Patent: Nov. 10, 2015

(54) PAINTING APPARATUS

(71) Applicant: Susan J. Ries, Burnsville, MN (US)

(72) Inventor: Susan J. Ries, Burnsville, MN (US)

( * ) Notice: Subject to any disclaimer, the term of this patent is extended or adjusted under 35 U.S.C. 154(b) by 276 days.

(21) Appl. No.: 13/645,342

(22) Filed: Oct. 4, 2012

Related U.S. Application Data

(63) Continuation-in-part of application No. 12/631,401, filed on Dec. 4, 2009, now abandoned.

(60) Provisional application No. 61/120,508, filed on Dec. 8, 2008.

(51) Int. Cl.

| | |
|---|---|
| ***B05C 1/06*** | (2006.01) |
| ***B05C 17/00*** | (2006.01) |
| ***B05C 17/10*** | (2006.01) |
| ***B05C 1/00*** | (2006.01) |

(52) U.S. Cl.
CPC ... *B05C 1/00* (2013.01); *B05C 1/06* (2013.01); *B05C 17/00* (2013.01); *B05C 17/10* (2013.01)

(58) Field of Classification Search
CPC ..... A47K 7/02; B05C 1/06; B05C 17/00
USPC ..... 15/143.1, 210.1, 244.1, 245.1; D28/7
See application file for complete search history.

(56) References Cited

U.S. PATENT DOCUMENTS

| | | | | | |
|---|---|---|---|---|---|
| D190,067 | S | * | 4/1961 | Reedy | D28/7 |
| 3,193,863 | A | | 7/1965 | Myers et al. | |
| 3,389,418 | A | * | 6/1968 | Sencabaugh | 15/244.1 |
| 3,821,829 | A | | 7/1974 | Finnerty | |
| 4,155,139 | A | | 5/1979 | Corcoran | |
| D299,558 | S | * | 1/1989 | Robison | D28/7 |
| D332,153 | S | * | 12/1992 | Butler | D28/7 |
| D344,814 | S | * | 3/1994 | Fath | D28/8 |
| 5,341,538 | A | * | 8/1994 | Banome | 15/210.1 |
| 5,692,261 | A | * | 12/1997 | Lops | 15/209.1 |
| D425,659 | S | * | 5/2000 | Larocque | D28/7 |
| 6,295,685 | B1 | | 10/2001 | Douglas | |
| 6,415,470 | B1 | * | 7/2002 | Ramrattan | 15/144.4 |
| 6,438,787 | B1 | * | 8/2002 | Young | 15/210.1 |
| 7,073,935 | B2 | * | 7/2006 | Liem | 366/129 |
| D617,944 | S | * | 6/2010 | Gonzalez | D28/7 |
| D636,121 | S | * | 4/2011 | Shuch | D28/7 |
| 2006/0075592 | A1 | * | 4/2006 | Sommers et al. | 15/244.1 |
| 2006/0248669 | A1 | | 11/2006 | Dovellos | |
| 2007/0157408 | A1 | * | 7/2007 | Bargiel et al. | 15/209.1 |

FOREIGN PATENT DOCUMENTS

| | | | |
|---|---|---|---|
| CA | 2111262 | A1 | 6/1995 |
| EP | 0872311 | A2 | 10/1998 |
| GB | 1230983 | A | 5/1971 |
| GB | 2090730 | A | 7/1982 |
| WO | 8603461 | A1 | 6/1986 |
| WO | 9832540 | A1 | 7/1998 |

* cited by examiner

*Primary Examiner* — Randall Chin
(74) *Attorney, Agent, or Firm* — Dicke, Billig & Czaja, PLLC

(57) ABSTRACT

A painting apparatus for applying paint to a painting surface within a narrow space. The painting apparatus includes a handle portion, an applicator portion and an applicator material. The handle portion is configured to prevent a user's hand from moving with respect to the handle portion while grasping the handle portion. The applicator portion is attached to the handle portion. The applicator material is arranged relative to an external surface of the applicator portion for applying paint to the painting surface.

18 Claims, 11 Drawing Sheets

PAINTING APPARATUS

REFERENCE TO RELATED APPLICATION

The present application is a continuation-in-part of U.S. application Ser. No. 12/631,401, which was filed on Dec. 4, 2009, now abandoned which claimed priority to U.S. Provisional Application No. 61/120,508, which was filed Dec. 8, 2008, the contents of which are expressly incorporated by reference herein.

FIELD OF THE INVENTION

The present invention generally relates to paint application devices. More particularly, the invention relates to a painting apparatus and method of use in connection with painting within narrow spaces.

BACKGROUND OF THE INVENTION

In certain situations it is desirable to mount objects close to surfaces to minimize the portion of the location in which the object is located that is occupied by the object. An example of one such object is a toilet. It is possible to mount the toilet close to a wall because it is generally not necessary to access the portion of the wall that is behind the toilet.

One of the primary times that it is necessary to access the space behind the toilet is when decorating. For example, it is generally desirable to paint the space behind the toilet when painting other portions of the wall that are not behind the toilet.

While conventional painting implements such as rollers and paint brushes may be used on the other portions of the wall that are not behind the toilet, the toilet is typically located sufficiently close to the wall such that it is not possible to access all of the space that is behind the toilet with a conventional roller or paint brush.

To overcome this limitation, it is common to disconnect at least a portion of the toilet to facilitate painting behind the toilet. A problem with disconnecting a portion of the toilet is that it may be necessary to have the portion of the toilet disconnected by a plumber because the toilet contains water and drain lines. Any water and/or waste that inadvertently escapes from the toilet may not only cause damage to the areas that surround the toilet, but also could present a health risk.

A need exists for improvement in paint application devices. This, and other needs, are addressed by one or more aspects of the present invention.

SUMMARY OF THE INVENTION

An embodiment of the invention is directed to a painting apparatus for applying paint to a painting surface within a narrow space. The painting apparatus includes a handle portion, an applicator portion and an applicator material.

The handle portion includes a proximal section, a distal section and an intermediate section. The proximal section has a maximum width and a maximum height. The distal section has a thumb engaging mechanism formed therein. The intermediate section has a maximum width and a maximum height. The proximal section and the distal section extend from opposite ends of the intermediate section.

At least one of the maximum width of the proximal section is larger than the maximum width of the intermediate section and the maximum height of the proximal section is larger than the maximum height of the intermediate section.

The applicator portion is attached to the handle portion. The applicator portion has first and second external surfaces are oriented opposite one another. The applicator material is arranged relative to at least one of the first and second external surfaces of the applicator portion for applying paint to the painting surface.

Another embodiment of the invention is directed to a painting apparatus for applying paint to a painting surface within a narrow space. The painting apparatus includes a handle portion, an applicator portion and an applicator material.

The handle portion includes a proximal section, a distal section and an intermediate section. The distal section has a thumb engaging mechanism formed therein. The proximal section and the distal section extend from opposite ends of the intermediate section. The proximal section is oriented at an obtuse angle with respect to the intermediate section.

The applicator portion is attached to the handle portion. The applicator portion has first and second external surfaces are oriented opposite one another. The applicator material is arranged relative to at least one of the first and second external surfaces of the applicator portion for applying paint to the painting surface.

Another embodiment of the invention is directed to a method of painting a surface to be painted within a narrow space. A painting apparatus is provided that includes a handle portion and an applicator portion offset from the handle portion. An applicator material is arranged relative to at least one external surface of the applicator portion.

At least a portion of the applicator material is immersed in a paint reservoir. The applicator material is positioned on the surface to be painted. The painting apparatus is moved relative to the surface to be painted to cause paint to be applied to the surface to be painted. Movement of a user's hand with respect to the handle portion is resisted with a plurality of channels on a surface of the handle portion. The channels define a plurality of ribs.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE PREFERRED EMBODIMENTS

Figure 1:
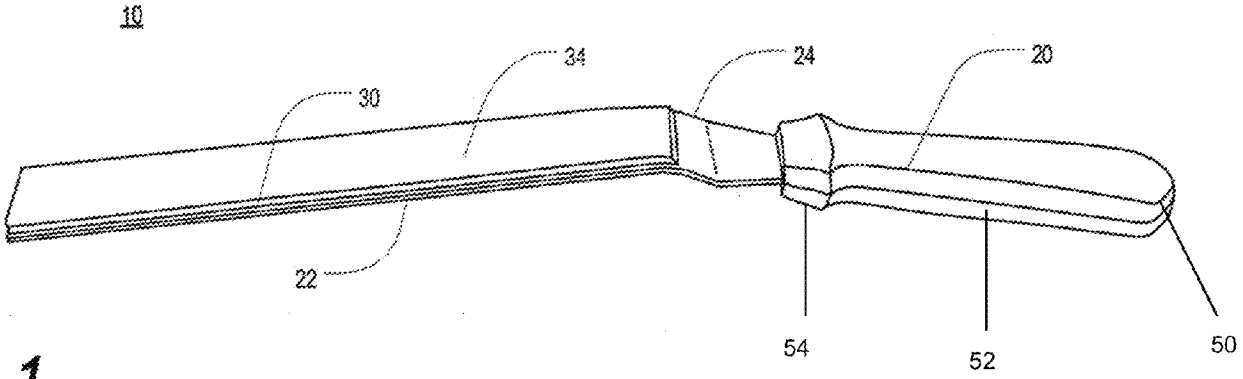
FIG. 1 is a perspective view of an embodiment of a painting apparatus in accordance with one or more aspects of the present invention.

Referring now to the drawings, one or more preferred embodiments of the present invention are next described. The following description of one or more preferred embodiments is merely exemplary in nature and is in no way intended to limit the invention, its implementations, or uses.

Figure 2:
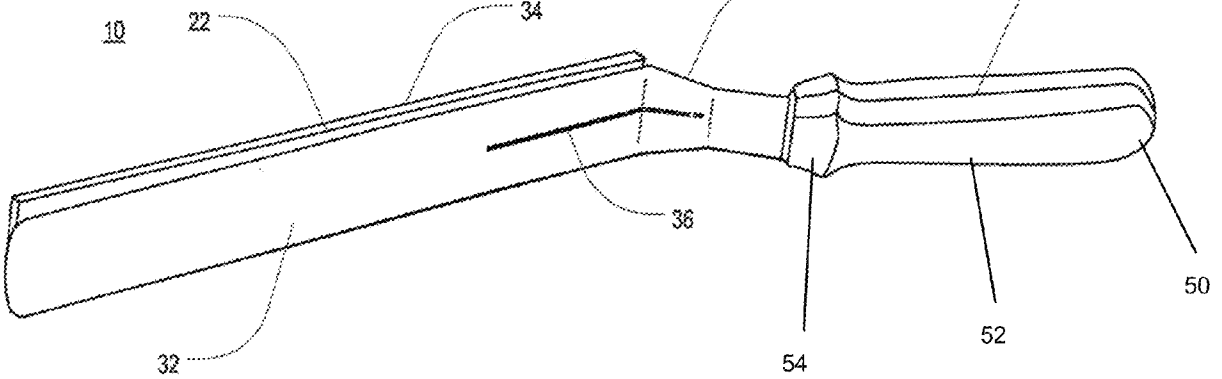
FIG. 2 is another perspective view of the painting apparatus of FIG. 1.
Figure 3:
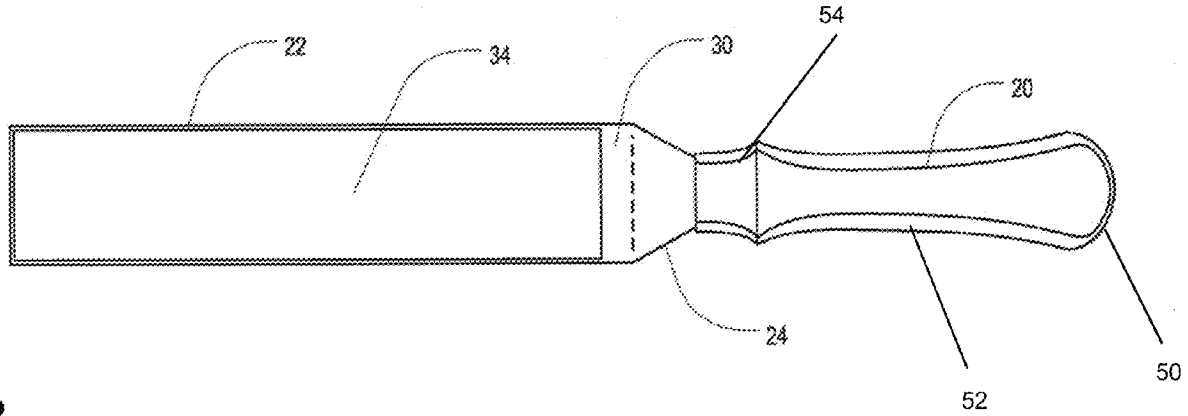
FIG. 3 is a top view of the painting apparatus of FIG. 1.
Figure 4:
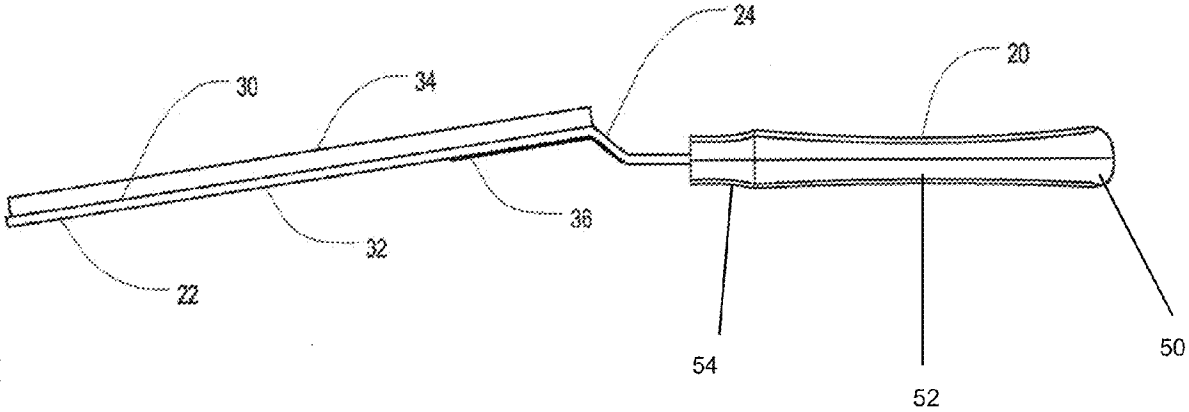
FIG. 4 is a side view of the painting apparatus of FIG. 1.

FIG. 1 is a perspective view of a preferred embodiment of a painting apparatus 10 in accordance with one or more aspects of the present invention. FIG. 2 is another perspective view of the painting apparatus 10 of FIG. 1. FIG. 3 is a top view of the painting apparatus 10 of FIG. 1. FIG. 4 is a side view of the painting apparatus 10 of FIG. 1.

The painting apparatus 10 aids in the application of paint to surfaces that are blocked or obstructed by objects placed close to the surfaces, such as toilets, stoves and refrigerators. Many such objects are very heavy or permanently mounted, and therefore difficult or impossible to move. As shown in FIGS. 1-4, the painting apparatus 10 comprises a handle portion 20, an applicator portion 22 and an intermediate portion 24.

In at least one embodiment, the handle portion 20 includes an elongated region configured to be grasped by a user of the painting apparatus 10. The elongated region may be formed with a length, width and outer surface contour to at least partially conform to the shape of the user's hand when closed.

The handle portion 20 includes several features that enhance the ability to hold onto the handle portion 20 if part of the handle portion 20 is covered with paint, which can reduce the ability to grasp the handle portion 20.

The handle portion 20 may generally be defined as including a proximal section 50, an intermediate section 52 and a distal section 54. In certain embodiments, the proximal section 50, the intermediate section 52 and the distal section 54 may be integrally formed.

The proximal section 50 may have a maximum width and/or a maximum height that is larger than a maximum width and/or a maximum height of the intermediate section 52. Forming the proximal section 50 with the maximum width and/or the maximum height that is larger than the maximum width and/or the maximum height of the intermediate section 52 reduces the potential of the user's hand slipping off of the end of the painting apparatus 10 because even if the user's hand is held slightly larger than the intermediate section 52, the user's hand will encounter the wider and/or higher proximal section 50 and thereby be prevented from sliding off the handle portion 20.

Forming the proximal section 50 with the maximum width and/or the maximum height that is larger than the maximum width and/or the maximum height of the intermediate section 52 also enables the user to sense the position of the user's hand on the handle portion 20 without the user having to view the position of the hand on the handle portion 20.

In certain embodiments, the maximum width and/or the maximum height of the proximal section 50 is more than 5 percent larger than the maximum width and/or the maximum height of the intermediate section 52. In other embodiments, the maximum width and/or the maximum height of the proximal section 50 is between about 10 and 30 percent larger than the maximum width and/or the maximum height of the intermediate section 52.

An upper surface 160 and at least a portion of side surfaces 162 of the proximal section 150 may be curved to generally conform to a shape of a portion of a user's hand who is holding the painting apparatus 110.

At least part of the upper surface 60 and the side surfaces 62 may be substantially smooth. Alternatively, at least part of the upper surface 60 and the side surfaces 62 may be textured to enhance the ability for the user to grasp the handle portion 20.

The proximal section 50 may encompass up to about 30 percent of a length of the handle portion 20. In certain embodiments, the proximal section 50 encompasses between about 10 percent and about 25 percent of the length of the handle portion 20.

At least one of the top surface and the bottom surface of the handle portion 20 may include a non-smooth transition (not shown) between the proximal section 50 and the intermediate section 52. In certain embodiment, the non-smooth transition is a ridge on the upper surface.

The non-smooth transition enhances the ability of the user to sense the position of the user's hand on the handle portion 20 without the user having to view the position of the hand on the handle portion 20.

The intermediate section 52 may encompass up to about 80 percent of a length of the handle portion 20. In certain embodiments, the intermediate section 52 encompasses between about 40 percent and about 80 percent of the length of the handle portion 20.

At least one of the top surface and the bottom surface of the handle portion 20 may include a non-smooth transition 66 between the distal section 54 and the intermediate section 52. In certain embodiment, the non-smooth transition is a ridge on the upper surface.

The non-smooth transition 66 enhances the ability of the user to sense the position of the user's hand on the handle portion 20 without the user having to view the position of the hand on the handle portion 20.

The handle portion 20 may be fabricated from the same material as the other components of the painting apparatus 10. Alternatively, the handle portion 20 may be fabricated from a material such as molded plastic.

The applicator portion 22 has a first surface 30 and a second surface 32 that are oriented opposite each other. In at least one embodiment, the first surface 30 is substantially flat and is adapted to receive an applicator material 34. It will further be appreciated that various embodiments of the applicator portion 22 are of varying lengths.

The difference in length of the applicator portion 22 depends on the size of the object behind which the user desires to paint. In at least one embodiment, the applicator portion 22 is between about 12 inches and about 18 inches. However, other embodiments may feature an applicator portion 22 as short as about 6 inches and as long as about 36 inches.

Depending on the length of the applicator portion 22 and the material from which the applicator portion 22 is formed, it may be necessary to strengthen the applicator portion 22 to ensure that an end of the applicator portion 22 that is opposite the handle portion 20 is sufficiently rigid to cause the paint to be applied to the surface.

An example of one such device that may be used to strengthen the applicator portion 22 is at least one rib 36 that extends from the second surface 32 along at least a portion of a length of the applicator portion 22.

The applicator portion 22 may be formed with a width that depends on factors such as the size of the object behind which it is desired to paint and the volume of paint that is desired to be held with the applicator material 34. For example, the wider the applicator material 34, the more paint that may be held in the applicator material 34, which reduces the frequency at which the applicator material 34 must be refilled with paint. In at least one embodiment, the width of the applicator portion 22 is about 6 inches. In alternative embodiments, the width is smaller, even as small as about 1 inch.

The applicator portion 22 may be formed from a variety of materials using the concepts of the invention. In some embodiments, the applicator portion 22 may be formed from a metallic material such as stainless steel. Forming the applicator portion 22 from stainless steel enables the applicator portion 22 to be relatively rigid and relatively thin.

The applicator material 34 may be formed from a variety of materials using the concepts of the invention such that the applicator material 34 is relatively thin and has the ability to absorb paint to facilitate applying the paint to the surface. In some embodiments, the applicator material 34 may be foam, bristles, fabric or some combination thereof.

In some embodiments, the applicator material 34 has a surface covering that is consistent over the entire surface thereof. In other embodiments, the applicator material 34 may have at least two applicator regions that are fabricated from different materials.

The applicator material 34 may be attached to the applicator portion 22 using a variety of techniques. In some embodiments, the applicator material 34 is permanently attached to the applicator portion 22. Using such a configuration, the painting apparatus 10 may be disposed of after use.

In other embodiments, the applicator material 34 may be removably attached to the applicator portion 22. An example of suitable techniques for removably attaching the applicator material 34 is an adhesive or a hook and loop fastener such as is available under the designation VELCRO.

Alternatively or additionally, a portion of the applicator material 34 may extend over at least a portion of the applicator portion 22 such that sliding of the applicator material 34 with respect to the applicator portion 22 facilitates attachment of or detachment of the applicator material 34 to the applicator portion 22. In such a configuration, a lock mechanism may be provided to retain the applicator material 34 in a desired location with respect to the applicator portion 22.

The intermediate portion 24 may offset the handle portion 20 from applicator portion 22 such that when the applicator portion 22 is positioned along a surface for applying paint to the surface, the handle portion 20 is located above the surface such that the user's hand does not contact the surface. In some embodiments, the offset between the handle portion 20 and the applicator portion 22 is up to about 6 inches.

In other embodiments, the offset between the handle portion 20 and the applicator portion 22 is between about 1 inch and about 3 inches. The intermediate portion 24 may be oriented at an angle with respect to the applicator portion 22. In some embodiments, the angle may be between about 20 and about 90 degrees.

The handle portion 20, the applicator portion 22 and the intermediate portion 24 may be oriented in different configurations. Examples of alternative configurations provide the painting apparatus 10 with a C-shape or an L-shape.

The intermediate portion 24 may be integrally formed with at least one of the handle portion 20 and the applicator portion 22. The intermediate portion 24 may have sufficient rigidity such that when a pressure is applied to the applicator portion 24 with the handle portion 20, the intermediate portion 24 resists deformation.

Figure 8:
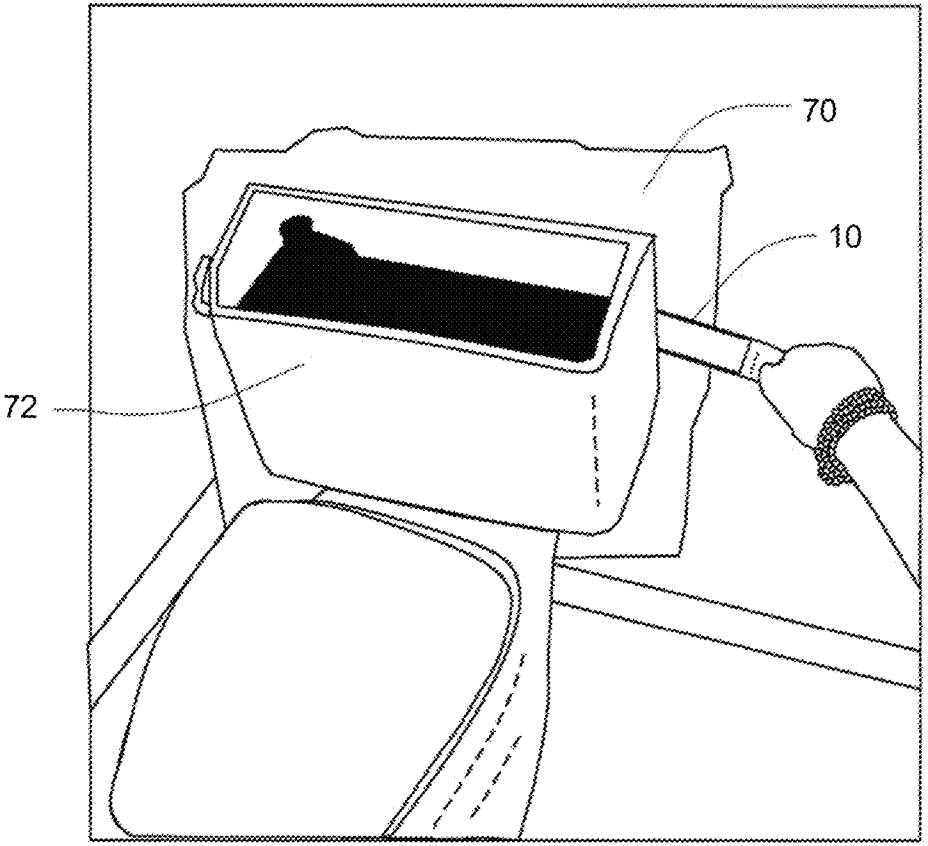
Figure 9:
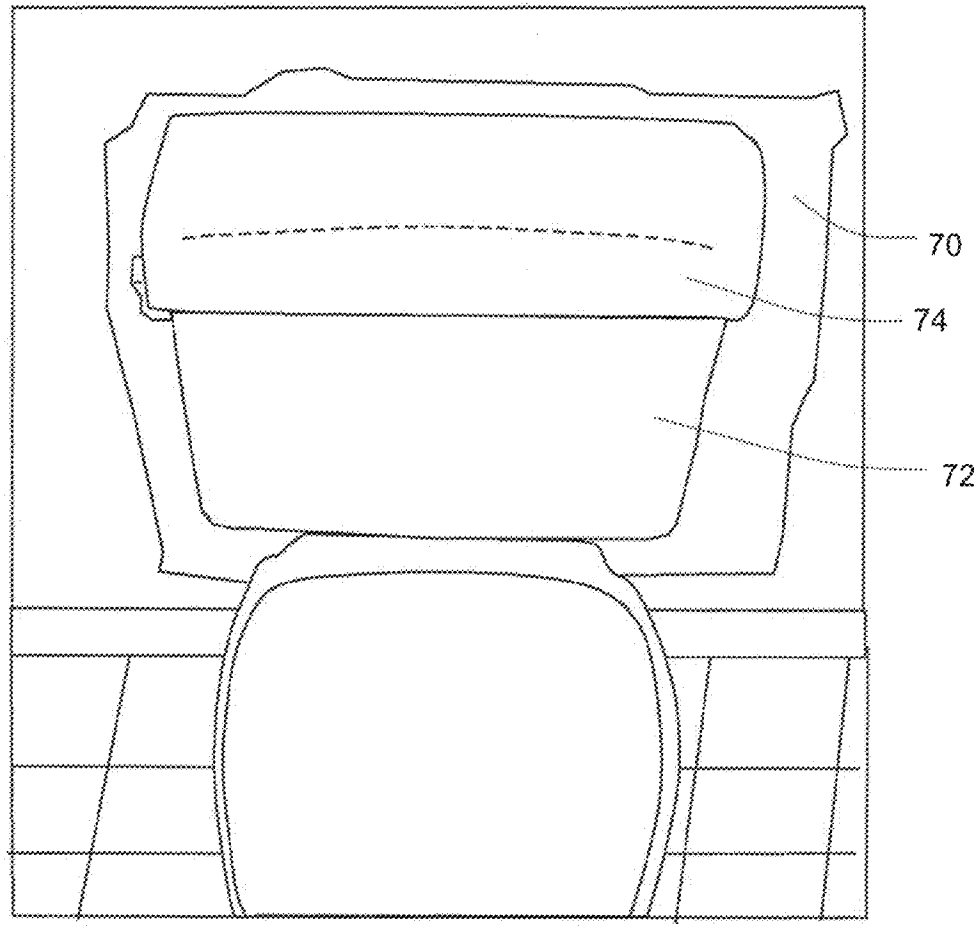
Figure 10:
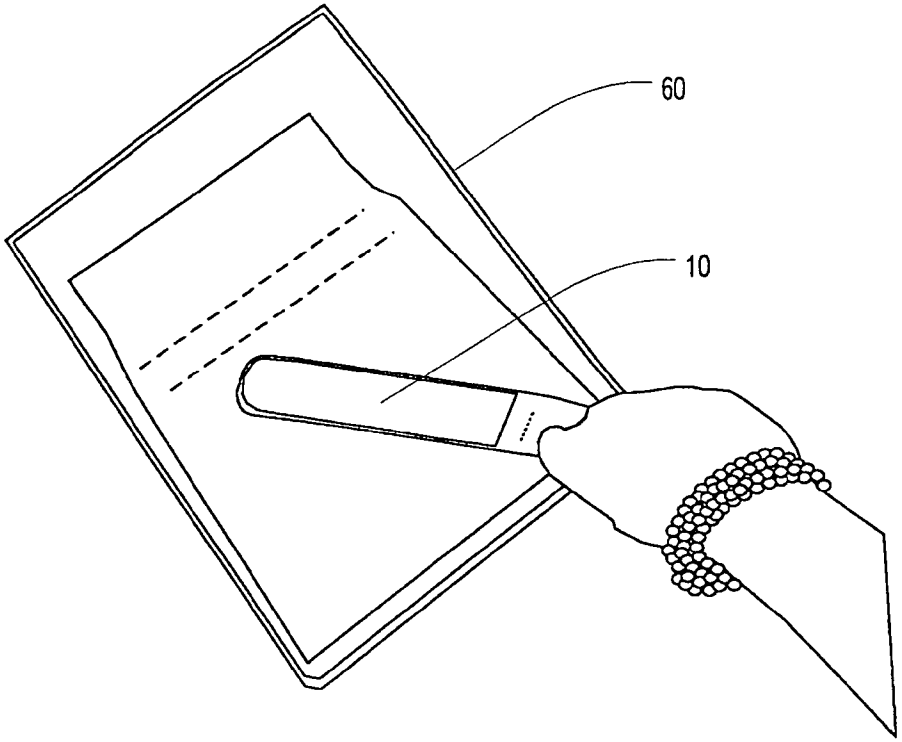
FIG. 10 is a first perspective view of the painting apparatus of FIG. 1 with a paint reservoir.
Figure 11:
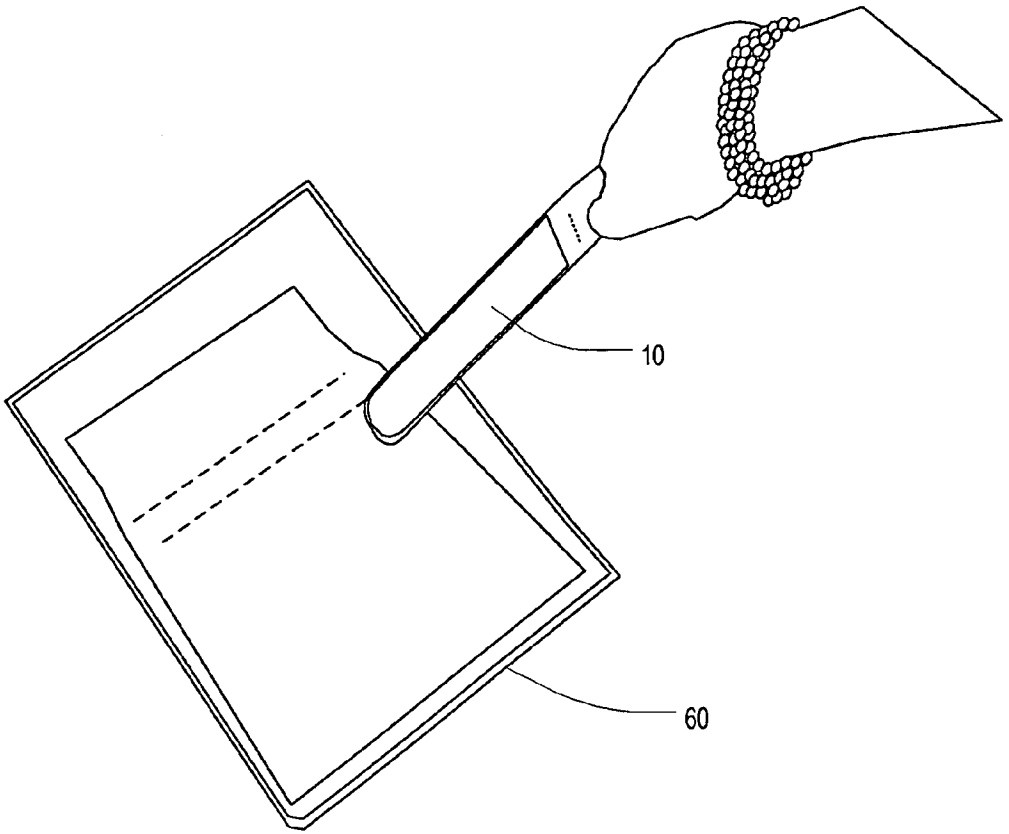
FIG. 11 is a second perspective view of the painting apparatus of FIG. 1 in an alternative position with respect to the paint reservoir.
Figure 12:
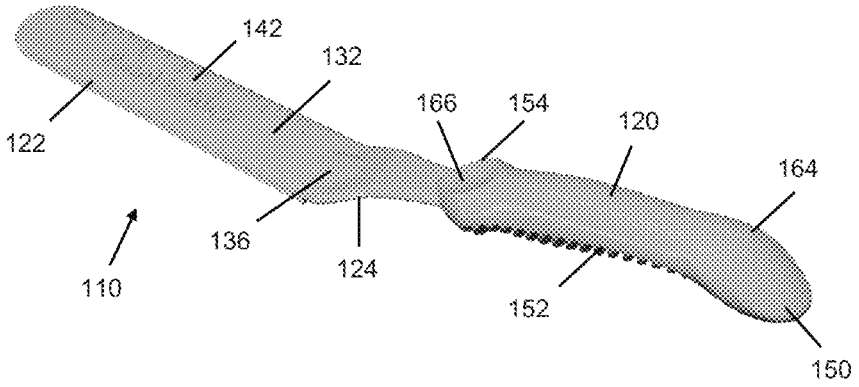
FIG. 12 is a first perspective view of an alternative embodiment of the painting apparatus.

FIGS. 5-9 are environmental views depicting the painting apparatus 10 of FIG. 1 in a method of use, and FIGS. 10-11 are perspective views of the painting apparatus 10 of FIG. 1 with a paint reservoir 60. While FIGS. 5-9 depict the painting apparatus 10 in a method of use to paint behind a toilet 72, it is also contemplated that the painting apparatus 10 may be used in a similar manner to paint other areas that may be difficult to access with conventional paint application devices, such as behind stoves and refrigerators.

Figure 5:
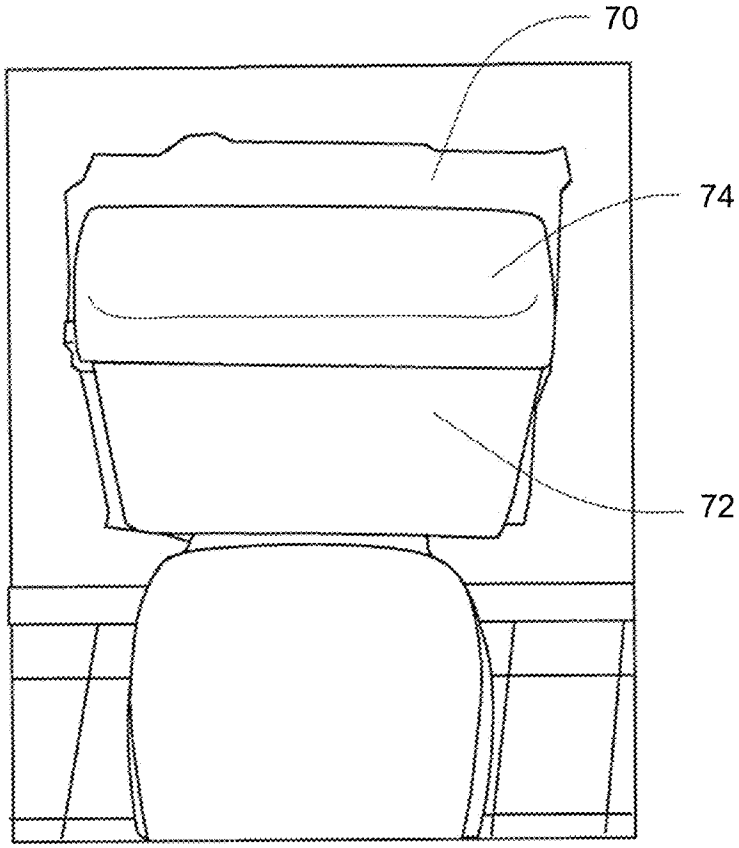
FIGS. 5-9 are environmental views depicting the painting apparatus of FIG. 1 in a method of use.

As shown in FIG. 5, a portion of a surface 70 that is not behind a toilet 72 may be painted using the painting apparatus 10. Alternatively, the painting apparatus 10 may be used to paint the surface 70 that is behind the toilet 72 before the other portions of the surface 70 are painted.

Figure 6:
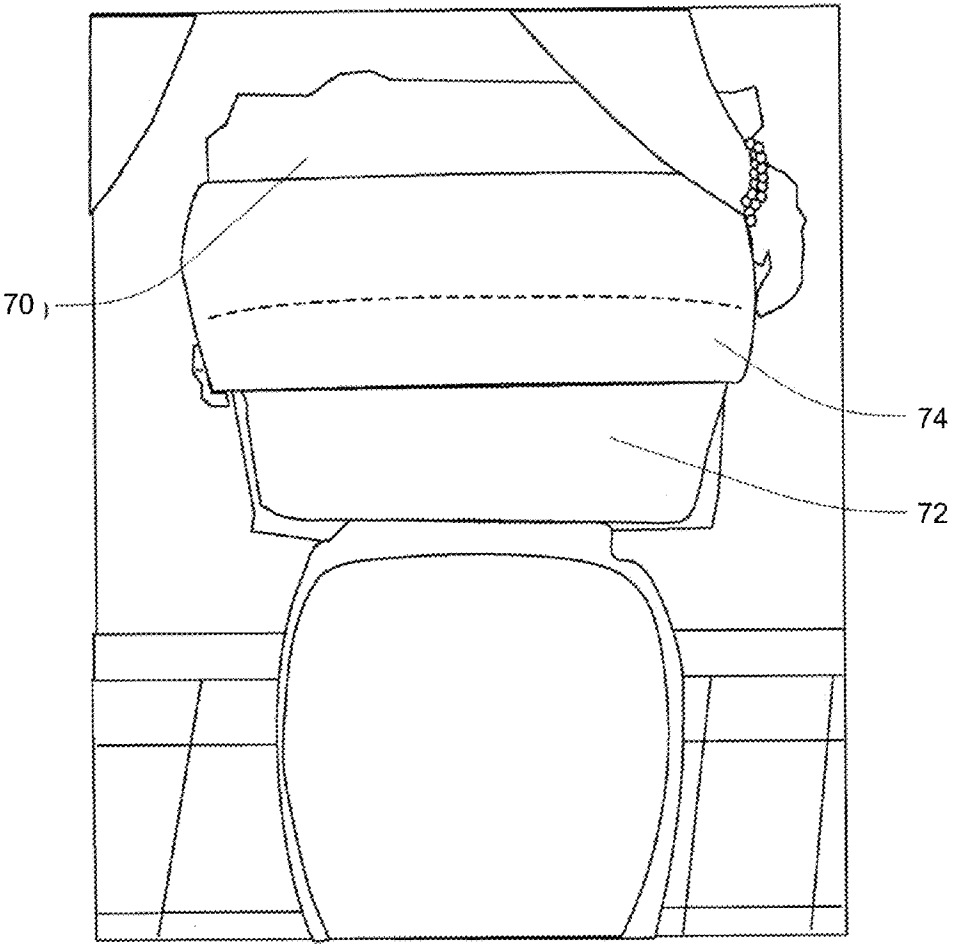

In an initial step, a top 74 of the toilet 72 may be removed, as shown in FIG. 6. The toilet 72 may be covered with a protective material such as a sheet of plastic. As shown in FIG. 10, the applicator material 34 is at least partially immersed in a paint reservoir 60 to cause the paint to be retained therein.

If the applicator material 34 soaks up excess paint, the applicator material 34 may be moved across an edge of a paint reservoir 60, as shown in FIG. 11, to remove some of the paint from the applicator material 34.

Figure 7:
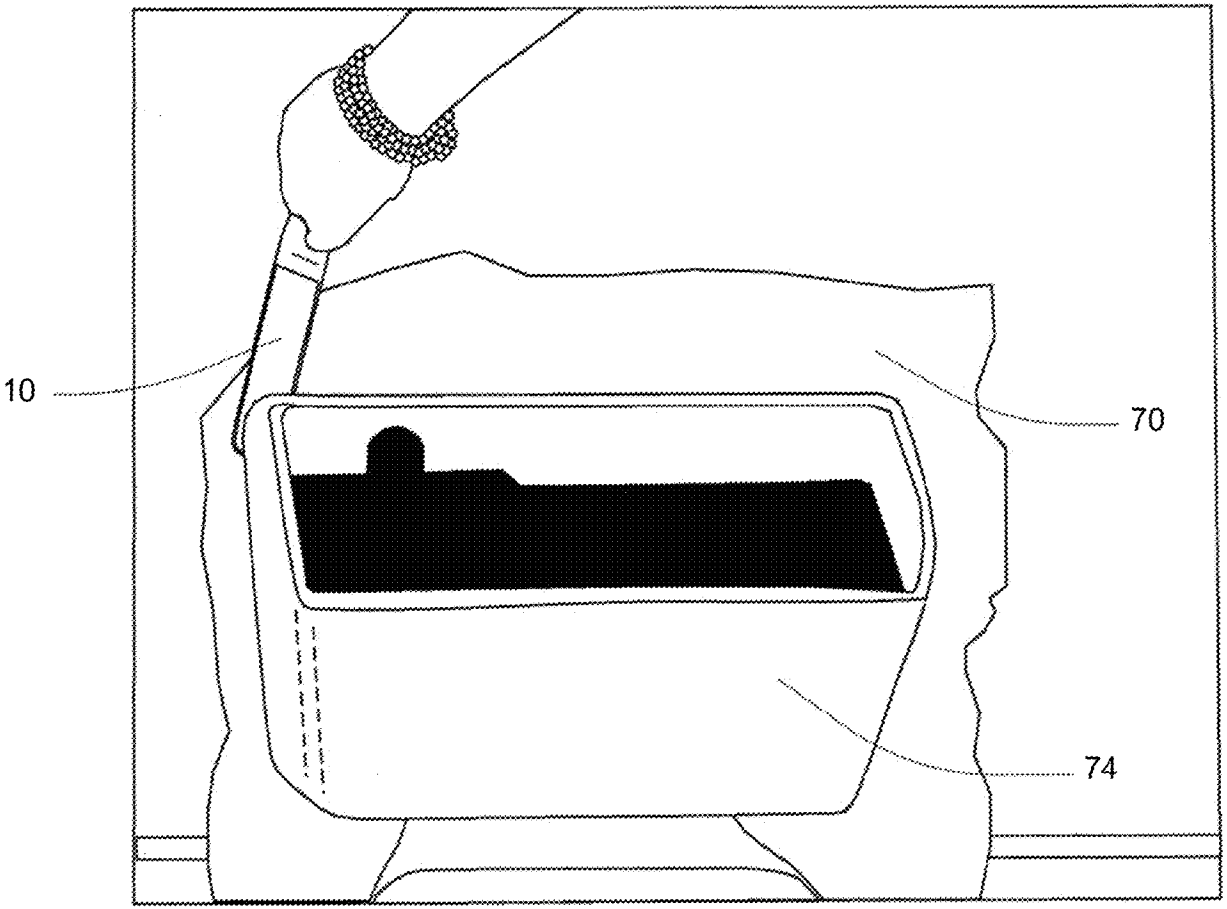

The painting apparatus 10 is then positioned so that the applicator material 34 is on the surface 70 that is at least partially behind the toilet 72, as shown in FIG. 7. The painting apparatus 10 is moved with respect to the surface 70 to cause paint to be applied to the surface 70.

The process may be repeated to apply paint to the surface 70 that is along the sides of the toilet 72, as shown in FIG. 8. Once the surface 70 behind the toilet 72 is painted, any protective material may be removed from the toilet 72 and the top 74 of the toilet 72 is replaced, as shown in FIG. 9.

An alternative embodiment of the painting apparatus 110 is set forth in FIGS. 12-16. The painting apparatus 110 includes a handle portion 120, an applicator portion 122 and an intermediate portion 124.

The handle portion 120 includes several features that enhance the ability to hold onto the handle portion 120 if part of the handle portion 120 is covered with paint, which can reduce the ability to grasp the handle portion 120.

The handle portion 120 may generally be defined as including a proximal section 150, an intermediate section 152 and a distal section 154. In certain embodiments, the proximal section 150, the intermediate section 152 and the distal section 154 may be integrally formed.

The proximal section 150 may be oriented at an angle with respect to the intermediate section 152. Orienting the proximal section 150 at an angle with respect to the intermediate section reduces the potential of a user's hand slipping off the end of the painting apparatus 110 while using the painting apparatus 110.

Orienting the proximal section 150 at an angle with respect to the intermediate section 152 also enables the user to sense the position of the user's hand on the handle portion 120 without the user having to view the position of the hand on the handle portion 120.

Figure 13:
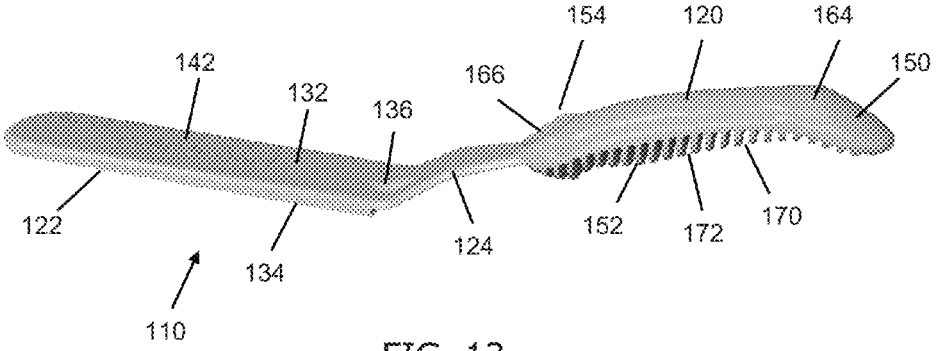
FIG. 13 is a second perspective view of the painting apparatus of FIG. 12.
Figure 14:
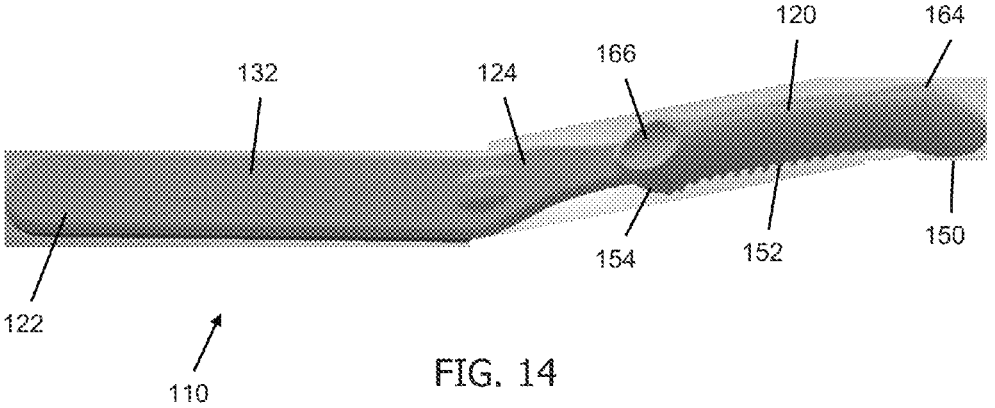
FIG. 14 is a top view of the painting apparatus of FIG. 12.
Figure 15:
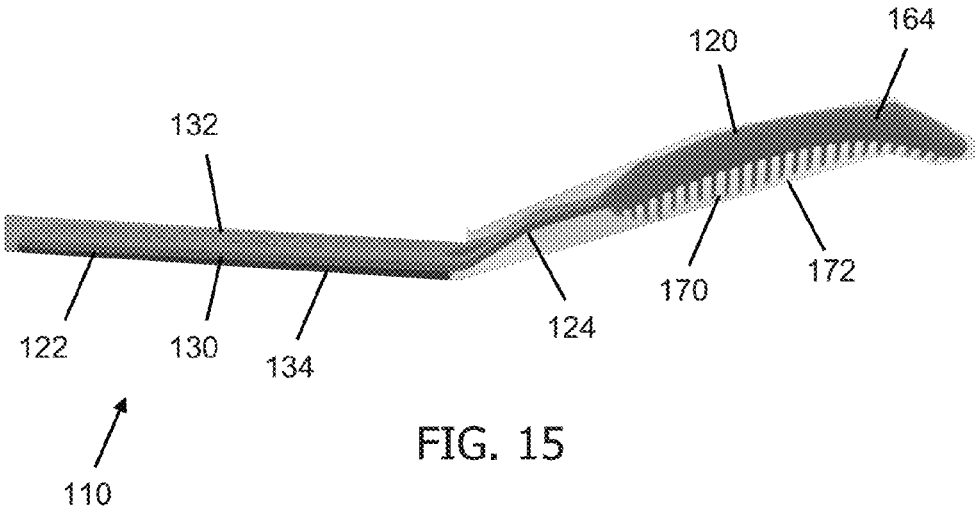
FIG. 15 is a side view of the painting apparatus of FIG. 12
Figure 16:
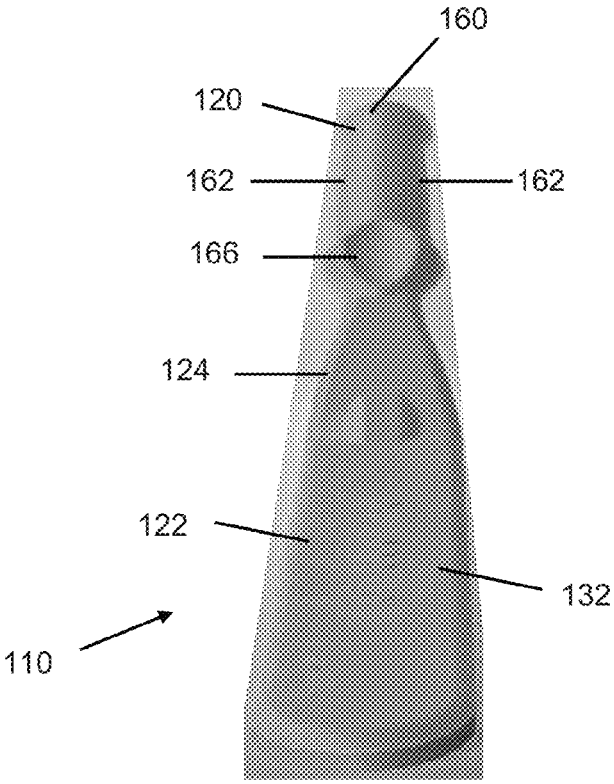
FIG. 16 is a front view of the painting apparatus of FIG. 12

In certain embodiments, when viewed from a side of the handle portion 120 as illustrated in FIGS. 13 and 15, the proximal section 150 is oriented at an obtuse angle with respect to the intermediate section 152. In other embodiments, an angle between the proximal section 150 and the intermediate section 152 is between about 145 degrees and about 170 degrees.

The proximal section 150 may have a maximum width and/or a maximum height that is larger than a maximum width and/or a maximum height of the intermediate section 152. Forming the proximal section 150 with the maximum width and/or the maximum height that is larger than the maximum width and/or the maximum height of the intermediate section 152 reduces the potential of the user's hand slipping off of the end of the painting apparatus 110 because even if the user's hand is slightly larger than the intermediate section 152, the user's hand will encounter the wider and/or higher proximal section 150.

Forming the proximal section 150 with the maximum width and/or the maximum height that is larger than the maximum width and/or the maximum height of the intermediate section 152 also enables the user to sense the position of the user's hand on the handle portion 120 without the user having to view the position of the hand on the handle portion 120.

In certain embodiments, the maximum width and/or the maximum height of the proximal section 150 is more than 5 percent larger than the maximum width and/or the maximum height of the intermediate section 152. In other embodiments, the maximum width and/or the maximum height of the proximal section 150 is between about 10 and 30 percent larger than the maximum width and/or the maximum height of the intermediate section 152.

An upper surface 160 and at least a portion of side surfaces 162 of the proximal section 150 may be curved to generally conform to a shape of a portion of a user's hand who is holding the painting apparatus 110.

At least part of the upper surface 160 and the side surfaces 162 may be substantially smooth. Alternatively, at least part of the upper surface 160 and the side surfaces 162 may be textured to enhance the ability for the user to grasp the handle portion 120.

The proximal section 150 may encompass up to about 30 percent of a length of the handle portion 120. In certain embodiments, the proximal section 150 encompasses between about 10 percent and about 25 percent of the length of the handle portion 120.

At least one of the top surface and the bottom surface of the handle portion 120 may include a non-smooth transition 164 between the proximal section 150 and the intermediate section 152. In certain embodiment, the non-smooth transition 164 is a ridge on the upper surface.

The non-smooth transition enhances the ability of the user to sense the position of the user's hand on the handle portion 120 without the user having to view the position of the hand on the handle portion 120.

The intermediate section 152 may encompass up to about 80 percent of a length of the handle portion 120. In certain embodiments, the intermediate section 152 encompasses between about 40 percent and about 80 percent of the length of the handle portion 120.

The distal section 154 may have a recess 166 formed in an upper surface thereof. The recess 166 is adapted to receive a portion of a tip of a user's thumb. The recess 166 enhances the ability of the user to sense the position of the user's hand on the handle portion 120 without the user having to view the position of the hand on the handle portion 120.

The recess 166 may have a width and a length that are slightly larger than a width and a length of the tip of the user's thumb. The width and the length of the recess 166 should not be significantly larger than the width and the length of the tip of the user's thumb because such a configuration would impair the ability of the user to utilize the position of the tip of the user's thumb as indicating the position of the user's hand on the handle portion 120. In certain embodiments, the width and the length of the recess 166 may each be between about ½ of an inch and 1 inch.

The recess 166 should have a depth that is sufficiently large such that the user can readily feel when the tip of the user's thumb is positioned in the recess 166 without the user having the visually see that the tip of the user's thumb is positioned in the recess 166.

However, the depth of the recess 166 should not be too great such that the user perceives the depression as being indicative of the end of the handle portion 120. Additionally, if the recess 166 is too deep, the user may experience discomfort caused by the user's thumb contacting the lip surrounding the recess 166.

In certain embodiments, the recess 166 has a depth of up to about ½ of an inch. In other embodiments, the recess 166 has a depth that is between about ⅛ of an inch and about ¼ of an inch.

A plurality of channels 170 is formed in a lower side of the handle portion 120. The channels 170 each have a depth that is between about 10 percent and about 50 percent of the height of the handle portion 120. In certain embodiments, the channels 170 may each have a depth that is approximately the same. In other embodiments, the channels 170 at different locations on the handle portion 120 may have different depths.

The plurality of channels 170 may be positioned in a spaced-apart relationship such that a spacing between each of the channels 170 is substantially equal. A width of the channels 170 may be approximately the same as a width of the ribs 172 that are positioned between each of the channels 170.

The channels 170 may be oriented at an angle with respect to an upper surface of the handle portion 120. In certain embodiments, the angle is between about 45 degrees and about 135 degrees. In other embodiments, the angle is between about 60 degrees and about 120 degrees.

In still other embodiments, the channels 170 are not oriented substantially transverse to the upper surface of the handle portion 120. By orienting the channels 170 at an angle with respect to the upper surface of the handle portion 120 that is not transverse to the upper surface, the ribs 172 are more likely to deflect when the handle portion 120 is grasped by the user's hand.

The rib 172 should be sufficiently wide so that the person using the painting apparatus 110 does not experience discomfort when contacting the edges of the ribs 172. In certain embodiments, the edges of the ribs 172 may be slightly curved.

Forming the channels 170 in the preceding manner provides the handle portion 120 with a lower surface that may be grasped by the user. However, the channels 170 are adapted to receive paint that is on the user's hand.

The channels 170 thereby can cause the paint to be scraped off of the user's hand as the person's hand moves with respect to the handle portion 120. Alternatively or additionally, the channels 170 receiving the paint enhance the ability of the user to grasp the handle portion 120.

The ribs 172 may be formed with a sufficiently thin thickness such that the ribs 172 are deflectable by manual pressure from the user's fingers when the user is holding the handle portion 120. The deflectable ribs 172 thereby enhance the comfort to the user such that the handle portion 120 may be fabricated from a single type of material that provides a rigid upper surface and a deflectable lower surface.

Yet another advantage of forming the channels 170 in the handle portion 120 is that the weight of the painting apparatus 110 is reduced when compared to the handle portion 120 that is formed from a solid piece of material. This reduced weight reduces fatigue to the user caused by holding a heavier painting apparatus that does not include the channels 170.

Furthermore, the channels 170 reduce the cost associated with manufacturing the painting apparatus 110 compared to a design that does not include the channels 170 because less material is used to fabricate the handle portion 120 of the painting apparatus 110 that includes the channels 170.

The distal section 154 may encompass up to about 30 percent of a length of the handle portion 120. In certain embodiments, the distal section 154 encompasses between about 10 percent and about 25 percent of the length of the handle portion 120.

The applicator portion 122 has a first surface 130 and a second surface 132 that are oriented opposite each other. In certain configurations, the first surface 130 is substantially flat and is adapted to receive an applicator material 134. Depending on the intended use of the painting apparatus 110, the applicator portion 122 may be formed of varying lengths.

One factor that may affect the length of the applicator portion 122 is the size of the object behind which the person using the painting apparatus 110 desires to paint. In certain embodiments, the applicator portion 122 has a length of between about 6 inches and about 36 inches. In other embodiments, the applicator portion 122 has a length of between about 12 inches and about 18 inches.

Depending on the material from which the applicator portion 122 is formed, it may be necessary to strengthen the applicator portion 122 to ensure that an end of the applicator portion 122 that is opposite the handle portion 120 is sufficiently rigid to cause the paint to be applied to the surface.

An example of one such strengthening device is a rib 136 that extends from the second surface 132 along at least a portion of a length of the applicator portion 122. As illustrated in FIGS. 12-16, the rib 136 may span an intersection between the applicator portion 122 and the intermediate portion 124.

The applicator portion 122 may be formed with a width that depends on factors such as the size of the object behind which it is desired to paint and the volume of paint that is desired to be held with the applicator material 134.

The applicator portion 122 may include measuring indicia 142 on a surface thereof. In certain embodiments, the measuring indicia 142 may be provided on the second surface 132.

The measuring indicia 142 may be positioned proximate to at least one of the edges of the applicator portion 122. In certain embodiments, the measuring indicia 142 extend substantially between a proximal end and a distal end of the applicator portion 122.

In certain embodiments, the measuring indicia 142 may be provided in inches. In addition to marks spaced one inch apart, the measuring indicia 142 may include a plurality of intermediate marks. The intermediate marks may be placed at a spacing of about ¼ of an inch. In addition to the marks, the measuring indicia 142 may also include numbers to facilitate the person using the painting apparatus 110 to readily determine the distance.

Depending on the material from which the applicator portion 122 is formed, the measuring indicia 142 may be integrally formed with the other parts of the applicator portion 122. In other embodiments, the measuring indicia 142 may be applied to the applicator portion 122. Examples of techniques that may be used to apply the measuring indicia 142 are painting or printing.

An advantage of using the indicia that are raised above a surface of the applicator portion 122 is that it may remain possible for the person using the painting apparatus 110 to view the measuring indicia 142 even after paint accumulates on the part of the applicator portion 122 where the measuring indicia 142 is located.

The measuring indicia 142 may be used to determine how far the person has painted in from an edge of the object that is located near to the wall. The measuring indicia 142 thereby enable the person to minimize the potential of not painting far enough behind an object from a first side. When this happens, the person would not realize that he or she has not painted far enough behind the object until the person had painted one of the other sides. In this situation, the person would have to go back to the first side for additional painting.

Such a situation is highly undesirable because it would not only increase the time associated with the painting project but could also present a significant issue that negatively impacts the outcome of the painting project if the paint along the first side had already begun to dry when the person comes back over to the first side for the additional painting The larger the width of the applicator material 134, the more paint that may be held in the applicator material 134, which thereby reduces the frequency at which the applicator must be refilled with paint. In certain embodiments, the width of the applicator material 134 is up to about 6 inches. In other embodiments, the width of the applicator material 134 is between about ½ of an inch and 2 inches.

In certain embodiments, the applicator material 134 has a surface covering that is consistent over the entire surface thereof. In other embodiments, the applicator material 134 may have at least two applicator regions that are fabricated from different materials.

The applicator material 134 may be attached to the applicator portion 122 using a variety of techniques. In certain embodiments, the applicator material 134 is permanently attached to the applicator portion 122. Using such a configuration, the painting apparatus 110 may be discarded after use.

In other embodiments, the applicator material 134 may be removably attached to the applicator portion 122. An example of one technique that may be used to removably attach the applicator material 134 to the applicator portion 122 is an adhesive or a hook and loop fastener such as is available under the designation VELCRO.

Alternatively or additionally, a portion of the applicator material 134 may extend over at least a portion of the applicator portion 122 such that sliding of the applicator material 134 with respect to the applicator portion 122 facilitates attachment or detachment of the applicator material 134 to the applicator portion 122. In such a configuration, a lock mechanism may be provided to retain the applicator material 134 in a desired location with respect to the applicator portion 122.

The intermediate portion 124 may offset the handle portion 120 from the applicator portion 122 such that when the applicator portion 122 is positioned along a surface for applying paint to the surface, the handle portion 120 is located above the surface such that the user's hand does not contact the surface.

In certain embodiments, the offset between the handle portion 120 and the applicator portion 122 is up to about 6 inches. In other embodiments, the offset between the handle portion 120 and the applicator portion 122 is between about 1 inch and about 3 inches.

The intermediate portion 124 may be oriented at an angle with respect to the applicator portion 122. In certain embodiments, the angle may be between about 20 degrees and about 90 degrees.

The handle portion 120, the applicator portion 122 and the intermediate portion 124 may be oriented in different configurations. Examples of the alternative configurations provide the painting apparatus 110 with a C-shape or an L-shape.

The intermediate portion 124 may be integrally formed with at least one of the handle portion 120 and the applicator portion 122. In other embodiments, the intermediate portion 124 may be fabricated separately from at least one of the handle portion 120 and the applicator portion 122.

The intermediate portion 124 should exhibit sufficient rigidity so that the handle portion 120 may be used to apply pressure to the applicator portion 124 without the intermediate portion 124 experiencing deformation.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

It will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention.

Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention.

The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise.

Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers."

Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

The invention claimed is:

1. A painting apparatus for applying paint to a painting surface within a narrow space, the painting apparatus comprising:
- a handle portion comprising:
  - a proximal section having a maximum width and a maximum height;
  - a distal section; and
  - an intermediate section having a maximum width and a maximum height, wherein the proximal section and the distal section extend from opposite ends of the intermediate section, wherein at least one of:
    - the maximum width of the proximal section is larger than the maximum width of the intermediate section; and
    - the maximum height of the proximal section is larger than the maximum height of the intermediate section, a plurality of channels formed in a surface of the handle portion, wherein the channels define a plurality of ribs that are positioned between the channels and wherein the ribs are deflectable in response to manual pressure from a person holding the handle portion;
- an applicator portion attached to the distal section, wherein the applicator portion has first and second external surfaces oriented opposite one another; and
- an applicator material arranged relative to at least one of the first and second external surfaces of the applicator portion for applying paint to the painting surface.

2. The painting apparatus of claim 1, wherein at least one of:
- the maximum width of the proximal section is between about 10 and 30 percent larger than the maximum width of the intermediate section; and the maximum height of the proximal section is between about 10 and 30 percent larger than the maximum height of the intermediate section.

3. The painting apparatus of claim 1, and further comprising a thumb engaging mechanism formed in the distal section, wherein the thumb engaging mechanism is a recess formed in a surface of the distal section.

4. The painting apparatus of claim 1, wherein the proximal section is oriented at an obtuse angle with respect to the intermediate section.

5. The painting apparatus of claim 1, wherein the plurality of channels extends from a lower surface of the handle portion and wherein the plurality of channels each have a depth that is between about 10 percent and 50 percent of a height of the handle portion.

6. The painting apparatus of claim 1, wherein the channels are each oriented at an angle that is not substantially transverse to an upper surface of the handle portion.

7. The painting apparatus of claim 1, and further comprising a non-smooth transition between the intermediate section and at least one of the proximal section and the distal section.

8. The painting apparatus of claim 1, and further comprising measuring indicia on the applicator portion.

9. The painting apparatus of claim 1, wherein the applicator material is selected from the group consisting of foam, bristles, fabric and combinations thereof.

10. A painting apparatus for applying paint to a painting surface within a narrow space, the painting apparatus comprising:

a handle portion comprising:

a proximal section;

a distal section; and an intermediate section, wherein the proximal section and the distal section extend from opposite ends of the intermediate section, wherein the proximal section is oriented at an obtuse angle with respect to the intermediate section, wherein a plurality of channels are formed in a surface of the handle portion, wherein the channels define a plurality of ribs that are positioned between the channels and wherein the ribs are deflectable in response to manual pressure from a person holding the handle portion;

an applicator portion attached to the distal section, wherein the applicator portion has first and second external surfaces oriented opposite one another; and an applicator material arranged relative to at least one of the first and second external surfaces of the applicator portion for applying paint to the painting surface.

11. The painting apparatus of claim 10, wherein the angle between the proximal section and the intermediate section is between about 145 degrees and about 170 degrees.

12. The painting apparatus of claim 10, and further comprising a thumb engaging mechanism formed in the distal section, wherein the thumb engaging mechanism is a recess formed in a surface of the distal section.

13. The painting apparatus of claim 10, wherein the plurality of channels extend from a lower surface of the handle portion, wherein the plurality of channels each have a depth that is between about 10 percent and 50 percent of a height of the handle portion, wherein the channels are each oriented at an angle that is not substantially transverse to an upper surface of the handle portion and wherein the ribs are deflectable in response to manual pressure from a person holding the handle portion.

14. The painting apparatus of claim 10, and further comprising a non-smooth transition between the intermediate section and at least one of the proximal section and the distal section.

15. The painting apparatus of claim 10, and further comprising measuring indicia on the applicator portion.

16. A painting apparatus for applying paint to a painting surface within a narrow space, the painting apparatus comprising:

a handle portion comprising:

a proximal section;

a distal section; and an intermediate section, wherein the proximal section and the distal section extend from opposite ends of the intermediate section, wherein the proximal section is oriented at an obtuse angle with respect to the intermediate section, wherein a plurality of channels are formed in a surface of the handle portion, wherein the channels define a plurality of ribs that are positioned between the channels, wherein the channels are each oriented at an angle that is not substantially transverse to an upper surface of the handle portion and wherein the ribs are deflectable in response to manual pressure from a person holding the handle portion;

an applicator portion attached to the distal section, wherein the applicator portion has first and second external surfaces oriented opposite one another; and an applicator material arranged relative to at least one of the first and second external surfaces of the applicator portion for applying paint to the painting surface.

17. The painting apparatus of claim 16, wherein the plurality of channels extend from a lower surface of the handle portion, wherein the plurality of channels each have a depth that is between about 10 percent and 50 percent of a height of the handle portion, wherein the channels are each oriented at an angle that is not substantially transverse to an upper surface of the handle portion and wherein the ribs are deflectable in response to manual pressure from a person holding the handle portion.

18. The painting apparatus of claim 16, and further comprising measuring indicia on the applicator portion.

* * * * *